US008889607B2

(12) United States Patent
Kuratomi et al.

(10) Patent No.: US 8,889,607 B2
(45) Date of Patent: Nov. 18, 2014

(54) LUBRICATING OIL COMPOSITION

(75) Inventors: Tadashi Kuratomi, Kitakyushu (JP); Katsumi Nagano, Tokyo (JP)

(73) Assignee: Nippon Steel & Sumikin Chemical Co., Ltd., Tokyo (JP)

( * ) Notice: Subject to any disclaimer, the term of this patent is extended or adjusted under 35 U.S.C. 154(b) by 82 days.

(21) Appl. No.: 13/634,005

(22) PCT Filed: Mar. 31, 2011

(86) PCT No.: PCT/JP2011/058226
§ 371 (c)(1),
(2), (4) Date: Sep. 11, 2012

(87) PCT Pub. No.: WO2011/125842
PCT Pub. Date: Oct. 13, 2011

(65) Prior Publication Data

US 2013/0005630 A1 Jan. 3, 2013

(30) Foreign Application Priority Data

Mar. 31, 2010 (JP) ..... 2010-081323

(51) Int. Cl.
*C10M 105/38* (2006.01)
*C07C 67/02* (2006.01)

(52) U.S. Cl.
CPC ..... *C10M 105/38* (2013.01); *C10M 2207/2835* (2013.01); *C10M 2215/064* (2013.01); *C10M 2215/223* (2013.01); *C10N 2240/204* (2013.01); *C10M 2215/28* (2013.01); *C10N 2240/04* (2013.01); *C10N 2230/02* (2013.01); *C10N 2240/02* (2013.01); *C10M 2215/086* (2013.01); *C10N 2230/74* (2013.01); *C10N 2220/022* (2013.01); *C10N 2240/08* (2013.01)
USPC ..... 508/485; 560/263

(58) Field of Classification Search
CPC ..... C10M 2207/2835; C10M 2207/2805; C10M 2207/28
USPC ..... 508/485; 560/263
See application file for complete search history.

(56) References Cited

U.S. PATENT DOCUMENTS

| | | | | |
|---|---|---|---|---|
| 8,153,569 | B2 | 4/2012 | Kuratomi et al. | |
| 2006/0019840 | A1 * | 1/2006 | Kawahara et al. | 508/280 |
| 2009/0318316 | A1 | 12/2009 | Morishima | |

FOREIGN PATENT DOCUMENTS

| | | | |
|---|---|---|---|
| EP | 0 406 479 | A1 | 1/1991 |
| JP | 7-224289 | A | 8/1995 |
| JP | 9-316029 | A | 12/1997 |
| JP | 09316029 | A * | 12/1997 |
| JP | 2000-336383 | A | 12/2000 |
| JP | 2005-154726 | A | 6/2005 |
| JP | 2007-39496 | A | 2/2007 |
| JP | 2008-214380 | A | 9/2008 |

OTHER PUBLICATIONS

International Preliminary Report on Patentability for Application No. PCT/JP2011/058226 mailed Nov. 22, 2012.
International Search Report for Application No. PCT/JP2011/058226 mailed Jun. 14, 2011.

* cited by examiner

*Primary Examiner* — Vishal Vasisth
(74) *Attorney, Agent, or Firm* — Cheng Law Group, PLLC

(57) ABSTRACT

A lubricating oil base oil includes, as a major component, a diester represented by the following formula (1), and a lubricating oil composition including the lubricating oil base oil. In the formula, $R_1$ and $R_2$ each independently represent a 1-ethylpentyl group, an n-heptyl group, or a n-hexyl group. When the diester in which both of $R_1$ and $R_2$ each represent an n-heptyl group or an n-hexyl group is defined as A, the diester in which one of $R_1$ and $R_2$ represents a 1-ethylpentyl group is B, and the diester in which both of $R_1$ and $R_2$ each represent a 1-ethylpentyl group is defined as C, the molar ratio of the diesters falls within a range of A:B:C=25 to 65:30 to 50:3 to 25.

(1)

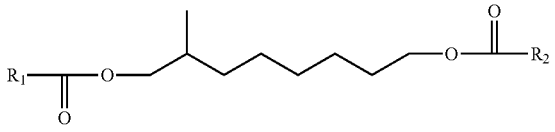

The lubricating oil base oil is suitable for a fluid dynamic pressure bearing, an oil-impregnated porous bearing, or a dynamic pressure-type oil-impregnated porous bearing.

11 Claims, No Drawings

LUBRICATING OIL COMPOSITION

This application is a 371 of PCT/JP2011/058226, filed Mar. 31, 2011.

TECHNICAL FIELD

The present invention relates to a lubricating oil base oil having characteristics of low volatility and excellent low-temperature fluidity and capable of providing long-lasting lubrication property in a wide temperature range from low temperature to high temperature, and a lubricating oil composition using the same.

BACKGROUND ART

A lubricating oil base oil is required to exert its performance stably for a long period of time, i.e., to have low volatility, excellent heat and oxidation stability and low-temperature startability (low-temperature fluidity), and a high viscosity index (wide range). In particular, it is not too much to say that a lubricating oil base oil having characteristics of low viscosity and low volatility is an ultimate aim.

Along with improvements in performance of audio-visual and office automation equipment, a small spindle motor used in a rotating part in the equipment has been strongly required to be refined so as to achieve speed-up and electrical power saving. Therefore, a bearing used in a rotation-supporting part has been constantly required to achieve low torque. Meanwhile, particularly recently, the bearing has been required to have performance applicable to various environments (temperatures) in consideration of use as a mobile device. As a factor having an effect on the torque of the bearing, there are given a bearing clearance and a shaft diameter. In particular, the viscosity of a lubricating oil in a low-temperature environment is a major factor.

In general, a lubricating oil having a lower viscosity tends to easily evaporate. When an amount of the lubricating oil decreases due to evaporation, or the like, the bearing is judged to come to the end of its life because of an inappropriate oil film pressure and significantly lowered rotation accuracy. Therefore, an evaporation characteristic of the lubricating oil is an important characteristic which affects durability of the bearing. Accordingly, in lubrication of a sliding bearing such as a fluid dynamic pressure bearing, an oil-impregnated porous bearing, or a dynamic pressure-type oil-impregnated porous bearing, it is necessary to select a lubricating oil which has a low viscosity, does not cause an increase in the viscosity even in a low temperature range, and has a relatively excellent evaporation characteristic. In many cases, an ester-based lubricating oil is used.

Like other lubricating oils, an ester oil tends to have a lower evaporation characteristic as the viscosity becomes lower. Therefore, to reduce the torque of the bearing, even when an ester oil having a lower viscosity than that of a conventional one is selected, the evaporation characteristic is impaired, resulting in a reduction in durability of the bearing. In addition, even when the oil has a low viscosity at ordinary temperature, a rapid increase in torque or stopping of devices may occur when the viscosity increases drastically or the fluidity is lost in a low temperature range.

Particularly, in recent years, hard disks are often installed in home electronics and may be used at low temperature in many cases. Therefore, in order to ensure stable driving, a low viscosity in a low temperature range has been strongly required. Many lubricating oil base oils have been proposed to satisfy such properties. However, in the present circumstances, the oils do not satisfy the low viscosity and low volatility which are ultimate aims although the oils satisfy the properties to some extent.

The low viscosity and low volatility contradict each other. For example, when the viscosity is reduced without changing its structure, the molecular weight decreases, naturally resulting in an increase in volatility. As means for solving such defects, an ester-based base oil having a low viscosity and relatively excellent evaporation property is used.

Patent Literature 1 discloses a lubricating oil composition including, as a base oil, a diester obtained from a linear divalent alcohol having 6 to 12 carbon atoms and a branched saturated monovalent fatty acid having 6 to 12 carbon atoms.

However, according to the conventional technology, a lubricating oil having low-viscosity property can be obtained by appropriately selecting an alcohol and a fatty acid. However, in the case of a diester having a viscosity at 40° C. of 10 $mm^2/s$ or less, the evaporation amount becomes larger as its molecular weight becomes lower. Further, the evaporation occurs concurrently owing to a uniform molecular weight, and hence the durability may drastically deteriorate from a certain condition. This is because many of esters have symmetrical chemical structures. That is, the limiting point is clear because of a single composition, and the evaporation may cause sudden stopping of the motor.

Patent Literature 2 discloses a lubricating oil composition which contains: as a major component, an ester synthesized from a monovalent alcohol having 8 carbon atoms and a divalent carboxylic acid having 6 carbon atoms; and, at a concentration of 1 to 5 wt %, a diester which is different from the major component, has a kinetic viscosity at 40° C. of 10 $mm^2/s$ or more, and has a total of 23 to 28 carbon atoms in its molecule, and a fluid bearing unit using the lubricating oil composition.

Patent Literature 3 describes a lubricating oil base oil containing, as a major component, a diester compound or a triester compound synthesized from a divalent or trivalent carboxylic acid having 9 or less carbon atoms and a monovalent glycol ether such as an alkylene glycol monoalkyl ether having 3 to 25 carbon atoms.

However, the lubricating oils or lubricating oil base oils described in the literatures do not fully satisfy the requirements of low viscosity and low volatility.

CITATION LIST

Patent Literature

[PTL 1] JP 2008-69234 A
[PTL 2] JP 2007-39496 A
[PTL 3] WO 2007/116725 A1

SUMMARY OF INVENTION

The present invention has been made in view of the above-mentioned problems, and an object of the present invention is to provide a lubricating oil base oil having characteristics of low volatility and excellent low-temperature fluidity and capable of providing long-lasting lubrication property in a wide temperature range from low temperature to high temperature, and a lubricating oil composition using the same.

The present invention relates to a lubricating oil base oil, including, as a major component, a diester represented by the following formula (1).

(1)

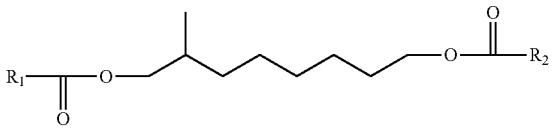

In the formula, $R_1$ and $R_2$ each independently represent a 1-ethylpentyl group, an n-heptyl group, or an n-hexyl group. Further, the molar ratio (A:B:C) falls within a range of 25 to 65:30 to 50:3 to 25. In this case, the diester in which both of $R_1$ and $R_2$ each represent an n-heptyl group or an n-hexyl group is defined as A, the diester in which one of $R_1$ and $R_2$ represents a 1-ethylpentyl group is defined as B, and the diester in which both of $R_1$ and $R_2$ each represent an 1-ethylpentyl group.

It is more preferred that the molar ratio (A:B:C) fall within a range of 35 to 50:40 to 50:5 to 15.

In the lubricating oil base oil of the present invention, it is preferred that the diester represented by the formula (1) be contained at a concentration of 50 wt % or more with respect to the lubricating oil base oil. Further, it is preferred that the lubricating oil base oil of the present invention include, at a concentration of 5 to 30 wt %, a low-viscosity oil which includes a polyol ester having a kinetic viscosity at 40° C. of less than 9 $mm^2/s$, having a viscosity index of 100 or more, and having a neopentyl glycol skeleton, in addition to the diester represented by the formula (1). It is preferred that the low-viscosity oil include a polyol ester obtained from caprylic acid or capric acid and neopentyl glycol.

The present invention also relates to a lubricating oil composition, which is obtained using the lubricating oil base oil.

DESCRIPTION OF EMBODIMENTS

Embodiments of the present invention are described below.

A lubricating oil base oil of the present invention includes a diester represented by the formula (1) as a major component. The oil contains the diester represented by the formula (1) preferably at a concentration of 50 wt % or more.

In the formula (1), $R_1$ and $R_2$ each represent a 1-ethylpentyl group, an n-heptyl group, or an n-hexyl group. $R_1$ and $R_2$ may be identical to or different from each other. In this case, the 1-ethylpentyl group is a branched alkyl group, and the n-heptyl group and n-hexyl group are linear alkyl groups. In the diester, $R_1$ and $R_2$ each represent a component derived from a carboxylic acid, specifically a component derived from 2-ethylhexanoic acid, caprylic acid, or enanthic acid. Further, in the diester, a component derived from an alcohol is 2-methyl-1,8-octanediol. The diester has no excessive branched chains, and hence the oil has a high viscosity index and a particularly low viscosity in a low temperature range. In addition, the oil is excellent in low evaporativity.

When the diester represented by the formula (1) is not a single compound but a mixture of diesters in which $R_1$ and $R_2$ vary in the above-mentioned range, it is possible to improve the viscosity at low temperature, evaporativity, and low-temperature fluidity.

In the case where the diester is a mixture of diesters, the molar ratio A:B:C in the formula (1) falls within a range of 25 to 65:30 to 50:3 to 25, preferably 35 to 50:40 to 50:5 to 15. In this case, A, B, and C have the above-mentioned meanings. A represents a diester having only a linear alkyl group, B represents a diester having both of a linear alkyl group and a branched alkyl group, and C represents a diester having only a branched alkyl group. When the ratio of the diesters is controlled, characteristics can be improved.

In the lubricating oil base oil of the present invention, the content of the diester is 50 wt % or more, preferably 65 wt % or more, more preferably 70 wt % or more with respect to the base oil. When the content falls within the above-mentioned range, the low viscosity and low evaporativity of the lubricating oil at low temperature can be improved sufficiently.

As a method of mixing any other base oil component by synthesis, there are given a method involving mixing a diol other than 2-methyl-1,8-octanediol and esterifying the components and a method involving mixing an acid other than 2-ethylhexanoic acid, caprylic acid, or enanthic acid and esterifying the components. As a method of mixing any other base oil component by mixing, there is given a method of mixing base oil components with an existing base oil such as an ester or a polyalphaolefin.

In particular, a lubricating oil base oil containing a low-viscosity oil which is a polyol ester having a kinetic viscosity at 40° C. of less than 9 $mm^2/s$, having a viscosity index of 100 or more, and having a neopentyl glycol skeleton among the other base oil components is preferred in that low-temperature fluidity can further be given while maintaining the low viscosity and low evaporativity of the lubricating oil at low temperature. When the base oil contains the low-viscosity oil, the content preferably falls within a range of 5 to 30 wt %. Further, the low-viscosity oil is preferably an esterification product of neopentyl glycol and capric acid or caprylic acid.

The diester included as a major component in the lubricating oil base oil of the present invention is obtained by allowing an alcohol component including 2-methyl-1,8-octanediol to react with an acid component including 2-ethylhexanoic acid, caprylic acid, and/or enanthic acid. In this case, the acid component needs to include 2-ethylhexanoic acid having a branched chain as an essential component, and may include one or both caprylic acid and enanthic acid. When a ratio of the acid component used is controlled, a diester which satisfies the above-mentioned molar ratio can be obtained. However, single diesters obtained from 2-methyl-1,8-octanediol and 2-ethylhexanoic acid may be blended.

The diester is prepared from the above-mentioned acid component and alcohol component in accordance with a conventional method preferably in an inert gas (such as nitrogen) atmosphere in the presence or absence of an esterification catalyst by stirring with heating or the like to diesterify the components. Specifically, a method of synthesizing a diester by esterification at high temperature while water generated by a condensation reaction is removed may be employed. The reaction may be performed without a catalyst or using a catalyst such as sulfuric acid, para-toluenesulfonic acid, or a tetrakis(alkoxy)titanate. The reaction may be performed further using an anhydrous solvent such as toluene, ethyl benzene, or xylene. In the esterification reaction, the acid component is used in an amount of, for example, 2.0 mol or more, preferably 2.01 to 4.5 mol with respect to 1 mol of the alcohol component.

The lubricating oil base oil of the present invention is used as a base oil for lubricating oil compositions such as a liquid lubricating oil and grease. The lubricating oil composition of the present invention is prepared by using the base oil and blending the base oil with a component for improving the performance of the lubricating oil composition in the base oil. Examples of the component include a known additive or thickener such as an antioxidant, an oiliness improver, a wear inhibitor, an extreme pressure agent, a metal deactivator, an anti-corrosive, a viscosity index improver, a pour point depressant, or an antifoamer. One or more kinds of such additives may be appropriately blended. Such additives are added at a concentration of preferably 0.01 to 10 wt %, more preferably 0.03 to 5 wt % with respect to the lubricating oil base oil.

In the case where the lubricating oil composition of the present invention is a grease, a thickener used in the composition is not particularly limited, and a thickener used in a general grease may appropriately be used. Examples thereof include a metal soap, a complexed soap, urea, an organic bentonite, and silica. In general, the content of the thickener in the grease is suitably 3 to 30 wt %. Further, one kind or two or more kinds of additives generally blended, such as an antioxidant, an extreme pressure agent, an anti-corrosive, a metal corrosion inhibitor, an oiliness improver, a viscosity index improver, a pour point depressant, or an adhesion improver may appropriately be blended in the grease. Such additives are usually added at a concentration of preferably 0.01 to 10 wt %, more preferably 0.03 to 5 wt % with respect to a grease base oil.

The lubricating oil composition including the lubricating oil base oil of the present invention can be used in: industrial lubricants such as a hydraulic oil, a gear oil, a spindle oil, and a bearing oil; and various applications such as a dynamic pressure bearing oil, an oil-impregnated sintered bearing oil, a hinge oil, a sewing machine oil, and a sliding surface oil. The composition as a grease is applicable to various lubricating parts such as bearing parts (ball, roller, and needle), sliding parts, and gear parts. In particular, the composition is advantageously applicable to a fluid bearing unit, a fluid dynamic pressure bearing unit, an oil-impregnated porous bearing unit, and a spindle motor equipped with such units.

Examples of preferred use of the lubricating oil composition of the present invention are shown below.

1) Fluid bearing unit: a bearing unit including a bearing part which supports a rotating shaft by an oil film pressure of a lubricating oil present in a gap between an axis outer periphery and a sleeve inner periphery, in which the lubricating oil composition of the present invention is used as a lubricant. 2) Fluid dynamic pressure bearing unit: a bearing unit including a dynamic pressure generating groove in anyone of the axis outer periphery and sleeve inner periphery, in which the lubricating oil composition of the present invention is used as a lubricant. 3) oil-impregnated porous bearing unit: a unit having an oil-impregnated porous bearing impregnated with the lubricating oil composition of the present invention. 4) Oil-impregnated porous bearing: a bearing impregnated with the lubricating oil composition of the present invention. Preferred examples of the oil-impregnated porous bearing include a dynamic pressure-type oil-impregnated porous bearing. 5) Spindle motor: a spindle motor equipped with the above-mentioned bearing units.

EXAMPLES

Hereinafter, the present invention is specifically described by way of examples. However, the present invention is by no means limited to the following examples. It should be noted that "%" means "wt %" unless otherwise stated.

Example 1

24.05 g of 2-methyl-1,8-octanediol as an aliphatic divalent alcohol and 32.01 g of caprylic acid and 54.51 g of 2-ethylhexanoic acid as saturated aliphatic monocarboxylic acids (hereinafter, referred to as carboxylic acids) were added to a reaction device including a 300-cc four-necked flask, a heating device, a stirring device, a thermometer, a nitrogen vent tube, a nitrogen line, a Dean-Stark tube, a cooling tube, and a cooling line, and subjected to a reaction using 0.1 g of tetrakis (IV) (2-ethyl-1-hexyloxy)titanate as a catalyst in a nitrogen atmosphere at 170° C. for 48 hours with stirring until full esterification was achieved. Most of carboxylic acids which remained in the reaction oil were distilled off at 10 Torr and 170° C., and the catalyst was deactivated. The acids which remained in the esters were neutralized, and unreacted compounds and impurities in the esters were removed by an adsorption treatment, to thereby obtain a diester (D1).

The composition of the diester was determined by a molar ratio calculated from an area ratio determined by gas chromatography. In the diester (D1), when the diester represented by the formula (1) in which none of $R_1$ and $R_2$ did not represent a branched alkyl chain was defined as A, the diester in which any one of $R_1$ and $R_2$ represented a branched alkyl chain was defined as B, and the diester in which both of $R_1$ and $R_2$ each represented a branched alkyl chain was defined as C, the composition was found to be A:B:C=47.9:42.7:9.4 (molar ratio), and the total of A, B, and C was found to account for 96.0% of the total composition.

Example 2

Raw materials including 24.05 g of 2-methyl-1,8-octanediol and 31.04 g of caprylic acid and 58.65 g of 2-ethylhexanoic acid as carboxylic acids were esterified in the same manner as in Example 1, to thereby obtain a diester (D2). The composition of the diester (D2) was found to be A:B:C=45.0:44.1:10.9, and the total of A, B, and C was found to account for 96.0% of the total composition.

Example 3

Raw materials including 24.05 g of 2-methyl-1,8-octanediol and 30.10 g of caprylic acid and 59.53 g of 2-ethylhexanoic acid as carboxylic acids were esterified in the same manner as in Example 1, to thereby obtain a diester (D1). The composition of the diester (D3) was found to be A:B:C=42.9:45.8:11.3, and the total of A, B, and C was found to account for 95.5% of the total composition.

Example 4

Raw materials including 24.05 g of a diol including 2-methyl-1,8-octanediol (83%) and 1,9-nonanediol (15%) and 29.04 g of caprylic acid and 59.53 g of 2-ethylhexanoic acid as carboxylic acids were esterified in the same manner as in Example 1, to thereby obtain a diester (D4). The composition of the diester (D4) was found to be A:B:C=39.4:46.6:14.0, and the total of A, B, and C was found to account for 82.8% of the total composition.

Example 5

The diester (D2) synthesized in Example 2 (95 wt %) was mixed with a diester of neopentyl glycol (5 wt %) (manufactured by Hatco), to thereby obtain a diester (D5)

Example 6

The diester (D2) synthesized in Example 2 (70 wt %) was mixed with H2962 (30 wt %), to thereby obtain a diester (D6).

Example 7

Raw materials including 32.05 g of 2-methyl-1,8-octanediol and 46.87 g of enanthic acid and 68.50 g of 2-ethylhexanoic acid as carboxylic acids were esterified in the same manner as in Example 1, to thereby obtain a diester (D11). The composition of the diester (D11) was found to be A:B:C=57.2:37.3:5.5, and the total of A, B, and C was found to account for 99.2% of the total composition.

Example 8

Raw materials including 32.05 g of 2-methyl-1,8-octanediol and 47.01 g of enanthic acid and 58.73 g of 2-ethylhexanoic acid as carboxylic acids were esterified in the same manner as in Example 1, to thereby obtain a diester (D12). The composition of the diester (D12) was found to be A:B:C=62.4:33.2:4.4, and the total of A, B, and C was found to account for 99.2% of the total composition.

Comparative Example 1

Raw materials including 2-methyl-1,8-octanediol and caprylic acid and 2-ethylhexanoic acid as carboxylic acids were esterified in the same manner as in Example 1, to thereby obtain a diester (D7). The composition of the diester (D7) was found to be A:B:C=74.5:23.5:2.0, and the total of A, B, and C was found to account for 98.0% of the total composition.

Comparative Example 2

Raw materials including a diol including 2-methyl-1,8-octanediol (83%) and 1,9-nonanediol (15%) and caprylic acid and 2-ethylhexanoic acid as carboxylic acids were esterified in the same manner as in Example 4, to thereby obtain a diester (D8). The composition of the diester (D8) was found to be A:B:C=22.9:49.9:14.0, and the total of A, B, and C was found to account for 83.7% of the total composition.

Comparative Example 3

Raw materials including 1,8-octanediol and 2-ethylhexanoic acid were esterified in the same manner as in Example 1, to thereby obtain a diester (D9).

Comparative Example 4

Raw materials including 2,4-diethyl-1,5-pentanediol and caprylic acid were esterified in the same manner as in Example 1, to thereby obtain a diester (D10).

Table 1 shows the totals of A, B, and C and various physical properties of the diesters (D1) to (D12) obtained in Examples and Comparative Examples.

TABLE 1

| | Total of A + B + C % | Kinetic viscosity $mm^2/s$ | Pour point ° C. | Acid number mgKOH/g | Evaporation loss % |
|---|---|---|---|---|---|
| Example 1 | 96.0 | 89.0 | −37.5 | 0.03 | 1.79 |
| 2 | 96.0 | 91.8 | −40.0 | 0.03 | 1.85 |
| 3 | 95.5 | 92.8 | −40.0 | 0.03 | 2.00 |
| 4 | 82.8 | 93.8 | −35.0 | 0.03 | 2.02 |
| 5 | 91.5 | 86.7 | −40.0 | 0.03 | 2.10 |
| 6 | 67.4 | 78.7 | <−45.0 | 0.03 | 2.78 |
| 7 | 99.2 | 66.3 | −45.0 | 0.03 | 2.41 |
| 8 | 99.2 | 62.4 | −40.0 | 0.03 | 2.65 |
| Comparative | 98.0 | 85.0 | −25.0 | 0.03 | 1.51 |

TABLE 1-continued

| | Total of A + B + C % | Kinetic viscosity $mm^2/s$ | Pour point ° C. | Acid number mgKOH/g | Evaporation loss % |
|---|---|---|---|---|---|
| Example 1 | | | | | |
| 2 | 83.7 | 95.9 | −40.0 | 0.03 | 2.35 |
| 3 | — | 95.3 | <−45.0 | 0.03 | 2.89 |
| 4 | — | 93.8 | <−45.0 | 0.03 | 4.20 |

In Table 1, the term "kinetic viscosity" refers to a value determined at −10° C. The term "evaporation loss" refers to a weight loss (%) determined after a diester has been kept at 120° C. for 8 hours in a thermobalance in a nitrogen atmosphere.

The diesters obtained in the foregoing were blended with the following additives to prepare lubricating oil compositions. Additives and abbreviations thereof L57: alkyldiphenylamine (IRGANOX L57 manufactured by BASF, antioxidant)

IR39: benzotriazole derivative (IRGAMET 39 manufactured by BASF, metal deactivator)

OAS1200: succinimide (OAS1200 manufactured by Chevron Chemical Company, ash-free dispersant)

Examples 9 to 11

Lubricating oil compositions were prepared by using as base oils the diesters (D2), (D5), and (D6) obtained in Examples 2, 5, and 6, respectively, and blending the diesters with 0.5 wt % of L57, 0.03 wt % of IR39, and 1.5 wt % of OAS1200.

Comparative Example 5

A lubricating oil composition was prepared by using the diester (D9) obtained in Comparative Example 3 as a base oil, and blending the diester with 0.5 wt % of L57, 0.03 wt % of IR39, and 1.5 wt % of OAS1200.

Each of the above-mentioned lubricating oil compositions was subjected to an evaporation test and evaluated on its rotating viscosity at −10° C. to simulate bearing torque when used in an oil-impregnated bearing.

The evaporation test was carried out under conditions of 100° C. and 6,000 hours. It should be noted that the evaporation test was carried out using LABORAN screw tubes #3 (volume: 9 ml) including 2 g of samples. The number n of the samples was defined as 2, and the average was determined as an evaporation loss. An evaporation loss of 0.5% or less, determined under conditions of 100° C. and 6,000 hours, was defined as an acceptability criterion for the lubricating oil compositions blended with additives. It is known that a lubricating oil having an evaporation loss of 0.5% or more tends to have an exponentially increased evaporation loss after a lapse of 6,000 hours.

The rotation property which causes a problem when the lubricating oil composition is used in an oil-impregnated bearing is low-temperature torque. In particular, when the rotating torque at −10° C. is large, the burden on a buttery increases. Therefore, the bearing torque in an actual machine was simulated by measuring the rotating viscosity at −10° C. It should be noted that a motor manufacturer requires use of a sample having a rotating viscosity at −10° C. of 100 mPa·s or less. Therefore, a value equal to or lower than the viscosity was defined as an acceptability criterion.

As a measurement device, SVM-3000 manufactured by Anton Paar was used.

TABLE 2

| | Base oil | Kinetic viscosity mPa · s | Pour point ° C. | Acid number mgKOH/g | Evaporation loss % |
|---|---|---|---|---|---|
| Example 9 | D2 | 96.2 | −37.5 | 0.03 | 0.39 |
| 10 | D5 | 95.1 | −32.5 | 0.03 | 0.41 |
| 11 | D6 | 87.7 | −42.5 | 0.03 | 0.45 |
| Comparative Example 5 | D9 | 102.9 | <−45.0 | 0.03 | 0.80 |

Table 2 shows the results of tests for evaluating the lubricating oil compositions in almost real conditions. The kinetic viscosity was measured at −10° C. In any of the examples, the evaporation loss was a value of 0.5% or less, which was about half that of the comparative example. In addition, the rotation property was also found to be lower than the standard value, and lubricating oil compositions having low torque at low temperature and exhibiting low evaporation at high temperature, which had a trade-off relationship and were difficult to achieve simultaneously, were obtained.

Specifically, the lubricating oil composition of Example 9 was found to have a lowest evaporation loss and a rotating viscosity lower than the standard value. Further, the compositions of Examples 10 and 11 prepared by using a polyol ester as part of the base oil were found to reduce the viscosities without remarkably inhibiting the evaporation losses. It should be noted that the lubricating composition of Comparative Example 5 was considered to have a best balance among existing base oils and has been adopted in many small motors. In this regard, development of a lubricating oil which has performance higher than that of the composition of the comparative example is considered to contribute to an improvement in performance of a small motor (extension of life-time and saving of energy)

INDUSTRIAL APPLICABILITY

The lubricating oil base oil according to the present invention can provide a lubricating oil composition having characteristics of low volatility and excellent low-temperature fluidity and capable of providing long-lasting lubrication property in a wide temperature range from low temperature to high temperature. In particular, it is possible to achieve low torque (in particular, low-temperature driving property) without impairing durability of a bearing for a small spindle motor related to information equipment.

The invention claimed is:

1. A lubricating oil base oil, comprising a diester represented by the following formula (1):

(1)

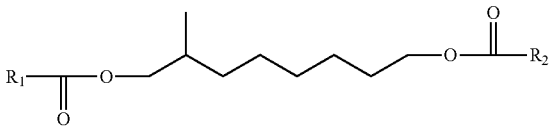

where: $R_1$ and $R_2$ each independently represent a 1-ethylpentyl group, an n-heptyl group, or an n-hexyl group; and when the diester in which both of $R_1$ and $R_2$ each represent an n-heptyl group or an n-hexyl group being a linear alkyl group is defined as A, the diester in which one of $R_1$ and $R_2$ represents a 1-ethylpentyl group being a branched alkyl group while the other one of R1 and R2 represents an n-heptyl group or an n-hexyl group being a linear alkyl group is defined as B, and the diester in which both of $R_1$ and $R_2$ each represent a 1-ethylpentyl group being a branched alkyl group is defined as C, a molar ratio A:B:C of the diesters falls within a range of 25 to 65:30 to 50:3 to 25.

2. A lubricating oil base oil according to claim 1, wherein, in the formula (1), the molar ratio A:B:C falls within a range of 35 to 50:40 to 50:5 to 15.

3. A lubricating oil base oil according to claim 1, wherein the diester represented by the formula (I) is contained at a concentration of 50 wt % or more with respect to the lubricating oil base oil.

4. A lubricating oil base oil according to claim 1, wherein the lubricating oil base oil comprises, at a concentration of 5 to 30 wt %, a low-viscosity oil which comprises a polyol ester having a kinetic viscosity at 40° C. of less than 9 $mm^2/s$, having a viscosity index of 100 or more, and having a neopentyl glycol skeleton.

5. A lubricating oil base oil according to claim 4, wherein the low-viscosity oil comprises a polyol ester obtained from caprylic acid or capric acid and neopentyl glycol.

6. A lubricating oil composition, which is obtained using the lubricating oil base oil according to claim 1.

7. A lubricating oil composition, which is obtained using the lubricating oil base oil according to claim 2.

8. A lubricating oil composition, which is obtained using the lubricating oil base oil according to claim 3.

9. A lubricating oil composition, which is obtained using the lubricating oil base oil according to claim 4.

10. A lubricating oil composition, which is obtained using the lubricating oil base oil according to claim 5.

11. A lubricating oil base oil according to claim 1, consisting essentially of the diester represented by the formula (1).

* * * * *